zontal pivoted joint 9 connecting the intermediate frame to the excavating unit frame as shown in FIG. 5 at 14'. Said independent mounting may be accomplished by the use of articulated joints 27 installed in or out of line with the joints 9.

The articulated connections 11 and 16 (FIGS. 1, 2) which hold the hydraulic cylinders to the excavating unit frame 4 and the intermediate frame 8 may be constructed in the form of ball joints comprising pins 28 (FIG. 6) and fulcrum balls 29.

The piston rods of the hydraulic cylinders and the upper end of the strut 14 (FIGS. 1, 2) may be connected coaxially by means of the joint 13.

The piston rod 30 (FIGS. 6, 7) of one of the hydraulic cylinders is ball-jointed as at 31 to a pin 32. The piston rod of the other hydraulic cylinder is connected to the pin 32 by means of a yoke 33. The pin 32 is articulated to another yoke 34 which is mounted rotatably in relation to the strut 14 by virtue of a cylindrical shank 3.

Another embodiment of the connection between the hydraulic cylinders and the strut provides for the cylinders to be attached to the strut independently and not coaxially by means of separate joints which may be of ball or other construction.

The mechanical transmission which conveys power to the bucket wheel receives drive from the tractor power takeoff 36 (FIGS. 1, 2) and comprises reduction gears and cardan drives 37 located above the turntable and the crossmember 18. The bucket-wheel drive reduction gear 38, which is connected to the transmission by means of a cardan drive and to the bucket wheel by means of chain drives 39, is fixedly mounted to the brackets 40 (FIGS. 1,2,4) of the turntable crossmember 18.

The bucket-wheel trench excavator constructed as described herein operates as follows:

Extending the two successively arranged cylinders 12 and 15 causes the intermediate frame 8 to turn about the front and rear horizontal-pivoted joints 10 and 9 which connect the intermediate frame 8 to the turntable crossmember 18 and the excavating unit frame 2. During this action the front joint 10 remains in place, whereas the rear joint 9 rises together with the front end of the excavating unit frame and all the associated components of the excavating unit, the rear end of the excavating unit constantly bearing on the wheeled support 3. Accordingly, by the action of this mechanism the machine is set in the working and transport positions and the depth of digging is varied.

When the intermediate frame 8 turns in relation to the excavating unit frame 4, the hydraulic cylinders 12 and 15 interact with the excavating unit frame, the intermediate frame and the diagonal strut 14 by virtue of the four-element linkage wherein the intermediate frame 8 and the excavating unit frame 4 are rigid elements, the two hydraulic cylinders 12 and 15 are arranged in succession, and the articulated joints provided between the frames and between the hydraulic cylinders are connected by the strut 14.

Owing to this constructional feature, when the intermediate frame is turned relatively to the excavating unit frame to either partial or full extent of its travel, i.e. throughout all the frame positions, a long and substantially non-decreasing distance is maintained between the axis of the hydraulic cylinders and the articulated joint 9 which connects the intermediate frame 8 to the excavating unit frame 4.

If the intermediate frame were turned in a conventional manner (for example, as described in USSR Inventor's Certificate No. 377486), i.e. by means of one hydraulic cylinder attached to the joints 11 and 16, the axis of the cylinder would lie on the line connecting said joints (FIG. 1), and the distance therefrom to the joint 9, as can be seen from the drawing, would be many times less that the distance to the axis of any of the cylinders 12 and 15 employed in the construction according to the invention.

Owing to this construction, the hydraulic cylinders, articulated joints and load-bearing structures are not subjected to great stresses and thereby the strength, weight and size of the mechanism can be reduced.

Should an attempt be made to position one hydraulic cylinder between the joints 11 and 16 at the same distance from the joint 9 as the distance therefrom to the axis of any of the cylinders 12 and 15, with the intermediate frame turned to the maximum angle (i.e. with the machine in the transport position, FIG. 1), the transfer of the machine into the working position (FIG. 2) would require a very long cylinder stroke (over 2 m in the case of a heavy machine), the length of the cylinder and the overall dimensions of the machine increasing beyond the permissible limits.

Thus, the construction described herein provides for making bucket-wheel trench excavators featuring moderate weight, ease of transportation, dependability and handiness along with ample power, high working capacity and capability of digging large trenches in difficult and frozen ground.

The vertical-pivoted joint 17 (FIGS. 1, 2, 3) constructed in the form of a slidably mounted flat turntable enables the excavating unit 2 and the intermediate frame 8 to turn in a horizontal plane to provide for manoeuvring in the transport position and digging trenches with small radii of curvature.

The horizontal-pivoted joint 10 connects the front end of the intermediate frame 8 to the crossmember 18 (FIG. 4) fixedly mounted on the rotatable disk 19. Mounted to the brackets 40 provided on the crossmember 18 is the bucket-wheel drive reduction gear 38 which transmits rotational motion through the articulated chain drives 39 to the bucket wheel 5. When the excavating unit turns relatively to the tractor in a horizontal plane, the articulated chain drives 39 and the reduction gear 38 turn together with the excavating unit and the intermediate frame.

The bucket-wheel power transmission, which includes the reduction gears and cardan drives 37 and the bucket-wheel drive reduction gear 38, is located above the turntable and is open to give free access for mounting, repair and maintenance.

The crossmember 18 (FIG. 4) turns together with the disk 19 and the locking ring 25 relatively to the stationary ring 21 accommodated in the stepped recess 20 in the disk 19 and fixedly mounted to the frame 23 of the prime mover 1.

The locking ring 25 limits upward axial movement and tilting movement of the disk 19 and, consequently, of the crossmember 18, the intermediate frame 8 and the entire excavating unit 2.

Inasmuch as the stepped recess 20, the locking ring 25 and the stationary ring 21 are located round the periphery of the disk 19, the entire structure, including the crossmember 18, easily takes heavy traction and, in particular, tilting loads transmitted from the excavating FIG. 1
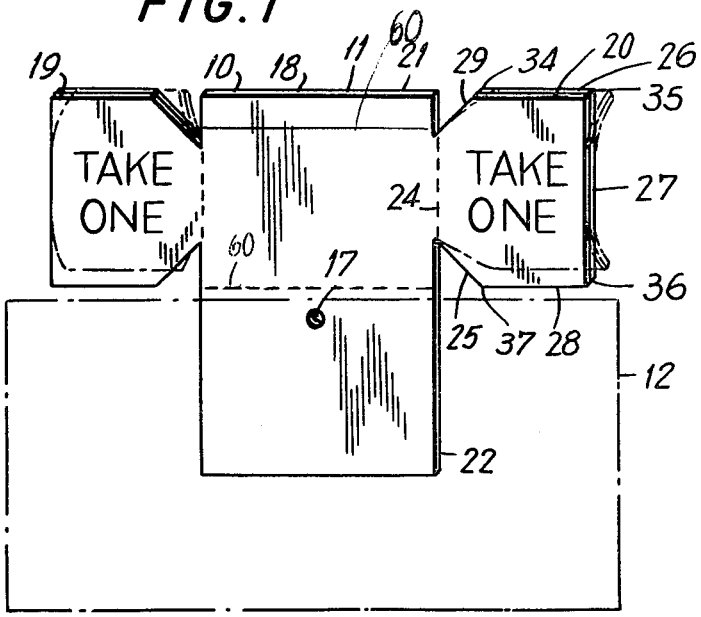
FIG. 2
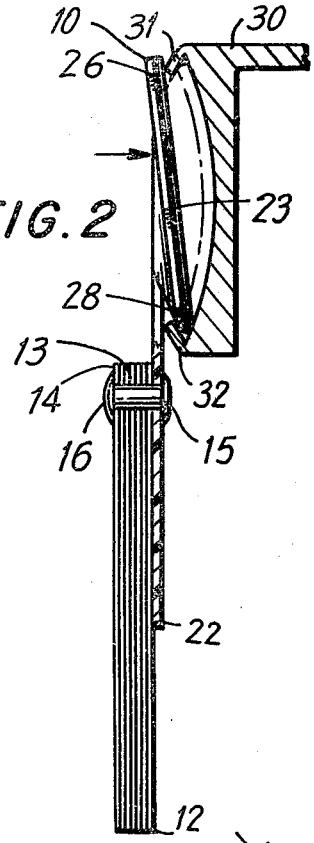
FIG. 3
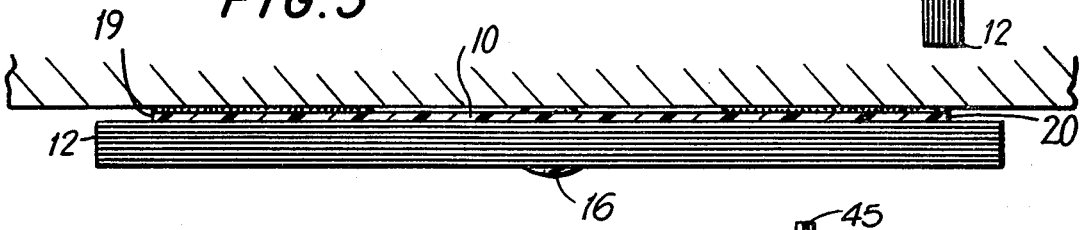
FIG. 4
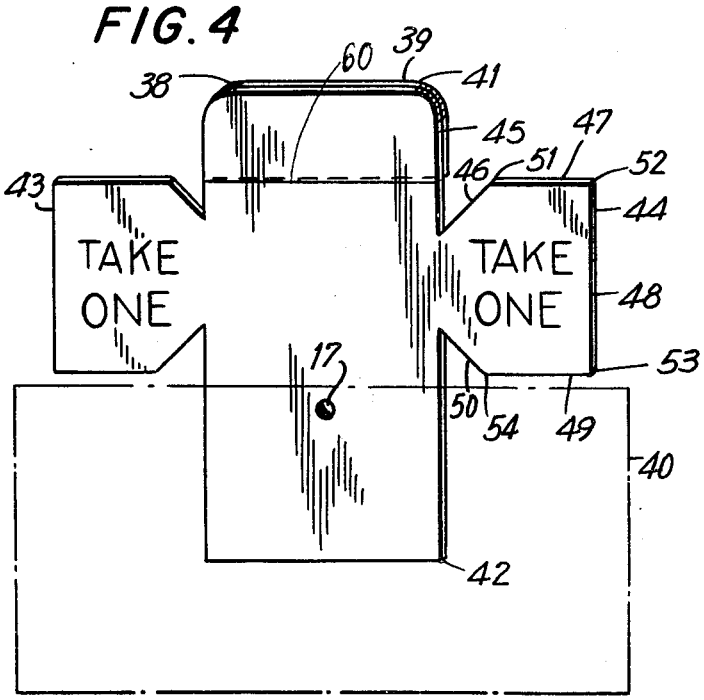
FIG. 5
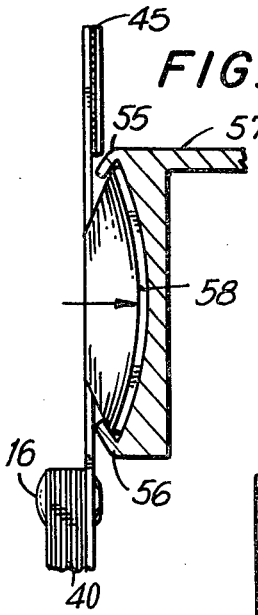
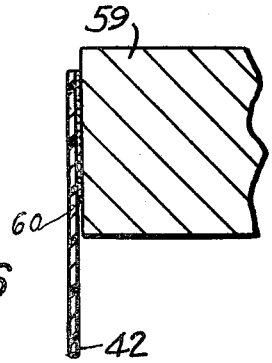
FIG. 6

STRESS RESISTANT SUPERMARKET DISPENSER FOR INFORMATIONAL SHEETS

RELATED APPLICATION

This application is a continuation-in-part of my copending application, Ser. No. 834,161 filed Sept. 19, 1977, now abandoned.

BACKGROUND OF THE INVENTION

The problem of distributing informational sheets in supermarkets, grocery stores, and the like is known, wherein large numbers of potential users necessitate the provision of dispensers which can withstand heavy utilization while obtaining the attention of customers. U.S. Pat. No. 4,016,977 granted Apr. 12, 1977 to Richard G. Krautsack, for example, discloses an assemblage in which a plate, or rectilinear configuration, supported by one of two means, permits distribution of such sheets. While such a device is of acknowledged utility in installations where limited amounts of stress through usage are placed on the device, a dispenser with increased stress resistant capacity is more practical for situations in which a heavy flow of users necessitates a superior support system.

SUMMARY OF THE INVENTION

Briefly stated, the invention contemplates the provision of a flexible synthetic resinous plate, having adhesive material on the rear surface thereof; providing an improved arrangement such that the plate is of cruciform configuration and support is provided by a shelf-indica and adhesion to a flat surface. Since the dispenser also possesses a greater surface area than prior art devices in the field of invention, the shopper's attention is more easily obtained; the greater surface area permitting the utilization, for example, of red block lettering on the additional available surface area. A part of the device is scored to permit facile bending when engagement with a horizontal shelf surface is made.

BRIEF DESCRIPTION OF THE DRAWINGS

In the drawing, to which reference will be made in the specification, similar reference characters have been employed to designate corresponding parts throughout the several views.

FIG. 1 is a front perspective view of a first embodiment of the invention.

FIG. 2 is a vertical sectional view as seen from the plan 2–2 in FIG. 1, showing the device being attached to a shelf.

FIG. 3 is a plan view thereof.

FIG. 4 is a front view of a second embodiment of the invention.

FIG. 5 is a side elevational view as seen from the right of FIG. 4, showing the device in attached condition to a shelf.

FIG. 6 is a side elevational view as seen from the right of FIG. 4, showing an additional means of attachment to a flat surface

DETAILED DESCRIPTION OF THE DISCLOSED EMBODIMENTS

In accordance with the first embodiment of the invention, the device, generally indicated by reference character 10, includes support means 11 for dispensing informational sheets 12. Each sheet has a hole 13 near the upper edge 14, through which a pin 15, having an enlarged head 16 may be placed; said pin passing through sheets 12 and support means 11 at hole 17 to be secured at rear thereof. The sheets 12 are pulled from pin 15 by tearing the sheet at a point to right, left, or therebelow. The support means 11, formed of opaque flexible synthetic resinous sheet material, such as polyethylene, is of cruciform configuration and includes a vertically positioned strip 18 and ears 19 and 20, symmetrically extending laterally from vertical strip 18. The horizontal dimension from ear 19 to ear 20 is greater than the vertical distance between head and base sections 21 and 22 of strip 18. Pressure sensitive adhesive 23, having a release liner covering said adhesive, coats the rear surface of ears 19 and 20. Ears 19 and 20 are identical, each being comprised of: horizontal parallel edges 26 and 28, vertical edge 27, diagonal edges 25 and 29, sharp corners 34–37, and edge 24, which unlike other edges is not free from, but is a part of support means 11.

The embodiment is attached to a shelf as parallel edges 26 and 28 of each ear, sharp corners 34–37 of said ears guarding against potential displacement of the same, are placed in channel 30, having top and bottom flanges 31 and 32. The liner of adhesive material 23 covering said ears is not removed, as inwardly directed pressure applied to the flexible synthetic resinous dispenser secures it against the inner surface of channel 30.

The stress resistant capacity of the informational sheet dispenser is substantial since support is provided by placement of ears 19 and 20, with sharp corners 34–37 within channel 30.

Turning now to the second embodiment of the invention, shown in FIGS. 4 to 6, generally indicated by reference character 38, comprised of similar support means 39 and informational sheets 40; said support means is differentiated from that of the first embodiment by its vertical dimension, such that the distance between head and base sections 41 and 42 is greater than that between 21 and 22. Ear to ear dimension (19 to 20, and 43 to 44) for both embodiments is equivalent, and attachment to and dispensation of said sheets from support means proceed in manner identical to that detailed in description of first embodiment. Adhesive material having a release liner covering said material coats the upper portion 45 of head section as well as the ears 43 and 44.

Support is provided to the second embodiment by either of two means, depending upon the nature of the surface to which the dispenser will be installed.

The first means, as shown in FIGS. 5–6, involves the placement of ears, comprised of edges 46–50 with sharp corners 51–54, within lower and upper flanges 55 and 56 of channel 57, is identical to that utilized with the first embodiment and attaches dispenser to said channel. Liner covering adhesive material, coating ears is not removed and inwardly directed pressure secures invention to channel surface 58; as the liner covering the upper portion 45 is removed, so that the dispenser is also secured to the flat surface directly above channel 57. Placement of ears 43 and 44 with sharp corners 51–54 of edges 46–50, within channel 57, provides a horizontal support base; adhesion of upper portion 45 to flat surface 59 provides a vertical support base as well.

The second means, utilized in situations in which an indicia channel is lacking, but a flat surface, possessing dimensions greater than or equal to the area of the dispenser coated with adhesive material is available. The liner from both ears 43 and 44 and upper portion 45 is removed, so that inwardly directed pressure permits an adhesive attachment between dispenser and said flat surface; such attachment providing the informational sheet dispenser with the capacity to withstand stressful utilization.

In both the first and second embodiments, a scored line 60 or 61 is provided which permits the respective device to be bent through substantially 90° whereby the adhesive material may be adhered to the horizontally disposed surface of a shelf 63. This permits a greater area of adhesive to be engaged, and causes applied stress to act in shear with greater resultant adhesive strength.

I wish it to be understood that I do not consider the invention limited to the precise details of structure shown and described in this specification, for obvious modifications will occur to those skilled in the art to which the invention pertains.

I claim:

1. In assemblage of items for presentation for dispensation in serial fashion, the assemblage including a plurality of informational sheetlike items, means for supporting said items selectively from an indicia bearing channel mounted upon an edge of a shelf or wall frame, said channel having top and bottom flanges, said support means including a flat support plate of flexible synthetic resinous material including a head and base section, a pair of ears, the improvement comprising:

said plate being of cruciform configuration including said pair of ears symmetrically extending laterally from a vertical strip, said ears being selectively inserted into said channel, and inwardly directed pressure applied to said ears securing said ears to inner surface of said channel; and adhesive means on the upper portion of said supporting means for attaching said upper portion of said dispenser to a flat surface, said plate being scored for bending through substantially 90° along a line below the location of said adhesive means.

* * * * *